US007100590B2

(12) United States Patent
Chang

(10) Patent No.: US 7,100,590 B2
(45) Date of Patent: Sep. 5, 2006

(54) BOWSTRING DRAWING DEVICE FOR A CROSSBOW

(75) Inventor: Chu-Wei Chang, Feng-Yuan (TW)

(73) Assignee: Poe Lang Enterprise Co., Ltd., Taichung Hsien (TW)

( * ) Notice: Subject to any disclaimer, the term of this patent is extended or adjusted under 35 U.S.C. 154(b) by 41 days.

(21) Appl. No.: 11/043,927

(22) Filed: Jan. 28, 2005

(65) Prior Publication Data

US 2006/0169258 A1 Aug. 3, 2006

(51) Int. Cl.
*F41B 5/12* (2006.01)

(52) U.S. Cl. ..... 124/25

(58) Field of Classification Search ..... 124/25
See application file for complete search history.

(56) References Cited

U.S. PATENT DOCUMENTS

| | | | | |
|---|---|---|---|---|
| 5,115,795 | A | 5/1992 | Farris | 124/86 |
| 5,243,956 | A | 9/1993 | Luehring | 124/86 |
| 6,913,007 | B1 | 7/2005 | Bednar | 124/25 |

*Primary Examiner*—John A. Ricci
(74) *Attorney, Agent, or Firm*—Rabin & Berdo, P.C.

(57) ABSTRACT

A bowstring drawing device for a crossbow has a mounting base, a reeling device and a hook. The mounting base has a rail. The reeling device has a casing with a bottom face and a rail recess defined in the bottom face of the casing to slidably engage with the rail of the mounting base. A wheel assembly is accommodated inside the casing and a crank arm connected to drive the wheel assembly. A clutch is operationally connected to the wheel assembly. The hook is retractably connected to the reeling device by a string. Because the reeling device and the mounting base are engaged with the rail and rail recess, detachment or engagement of the reeling device is convenient. Moreover, the crank arm and the wheel assembly also make the operation of the bowstring drawing device effort-saving.

9 Claims, 10 Drawing Sheets

BOWSTRING DRAWING DEVICE FOR A CROSSBOW

BACKGROUND OF THE INVENTION

1. Field of the Invention

The present invention relates to a bowstring drawing device for a crossbow, and more particularly to a bowstring drawing device that is detachably mounted on the crossbow and is easily operated.

2. Description of Related Art

With reference to FIG. 10, a conventional bowstring drawing device is undetachably mounted on a crossbow (50) and comprises a reeling device (60) and a hook (70). The crossbow (50) contains a butt (52), a barrel (54), a bowstring holder (56) and a bow assembly (58). The barrel (54) is attached between the butt (52) and the bow assembly (58) and has a front end, a rear end, and a trigger (542). The bowstring holder (56) is mounted at the rear end of the barrel (54). The trigger (542) is movably attached under the barrel (54) to operationally actuate the bowstring holder (56).

The reeling device (60) is directly mounted on butt (52) and can not be detached from the crossbow. The hook (70) is slidably mounted on the barrel (54) to draw the bowstring to the bowstring holder (56) by operating the reeling device (60). However, because the reeling device (60) is undetachable from the butt (54), the bowstring drawing device (60) may become an obstacle and redundant accessory when some users do not want to use the bowstring drawing device (60).

To overcome the shortcomings, the present invention provides an improved and detachable bowstring drawing device to obviate the aforementioned problems.

SUMMARY OF THE INVENTION

The main objective of the invention is to provide a bowstring drawing device that is easily operated and particularly conveniently detachable from the crossbow.

To achieve the foregoing main objective, the bowstring drawing device for a crossbow comprises a mounting base, a reeling device and a hook.

The mounting base is adapted to mount on a butt of the crossbow and has a rail. The reeling device is detachably attached to the mounting base and has

- a casing with a bottom face,
- a wheel assembly accommodated inside the casing,
- a rail recess defined in the bottom face of the casing to slidably engage with the rail of the mounting base,
- a crank arm connected to drive the wheel assembly, and
- a clutch operationally connected to the wheel assembly.

The hook is retractably connected to the reeling device by a string.

Because the reeling device and the mounting base are engaged by means of rail and rail recess, detachment or engagement of the reeling device is easy and convenient. Moreover, the crank arm and the wheel assembly also make the operation of the bowstring drawing device effort-saving.

Other objects, advantages and novel features of the invention will become more apparent from the following detailed description when taken in conjunction with the accompanying drawings.

DETAILED DESCRIPTION OF PREFERRED EMBODIMENT

A bowstring drawing device for a crossbow in accordance with the present invention comprises a mounting base, a reeling device and a hook. The mounting base is adapted to mount on a butt of the crossbow and has a rail. The reeling device is detachably attached to the mounting base and has a casing, a wheel assembly, a rail recess, a crank arm, and a clutch. The casing has a bottom face and the rail recess is defined in the bottom face of the casing to slidably engage with the rail of the mounting base. The wheel assembly is accommodated inside the casing. The crank arm connects with and drives the wheel assembly. The clutch is operationally connected to the wheel assembly to lock or release the wheel assembly. The hook is retractably connected to the reeling device by a string.

Because the reeling device and the mounting base are engaged by means of the rail and rail recess, detachment or engagement of the reeling device is easy and convenient. Moreover, the crank arm and the wheel assembly also make the operation of the bowstring drawing device effort-saving.

Figure 1:
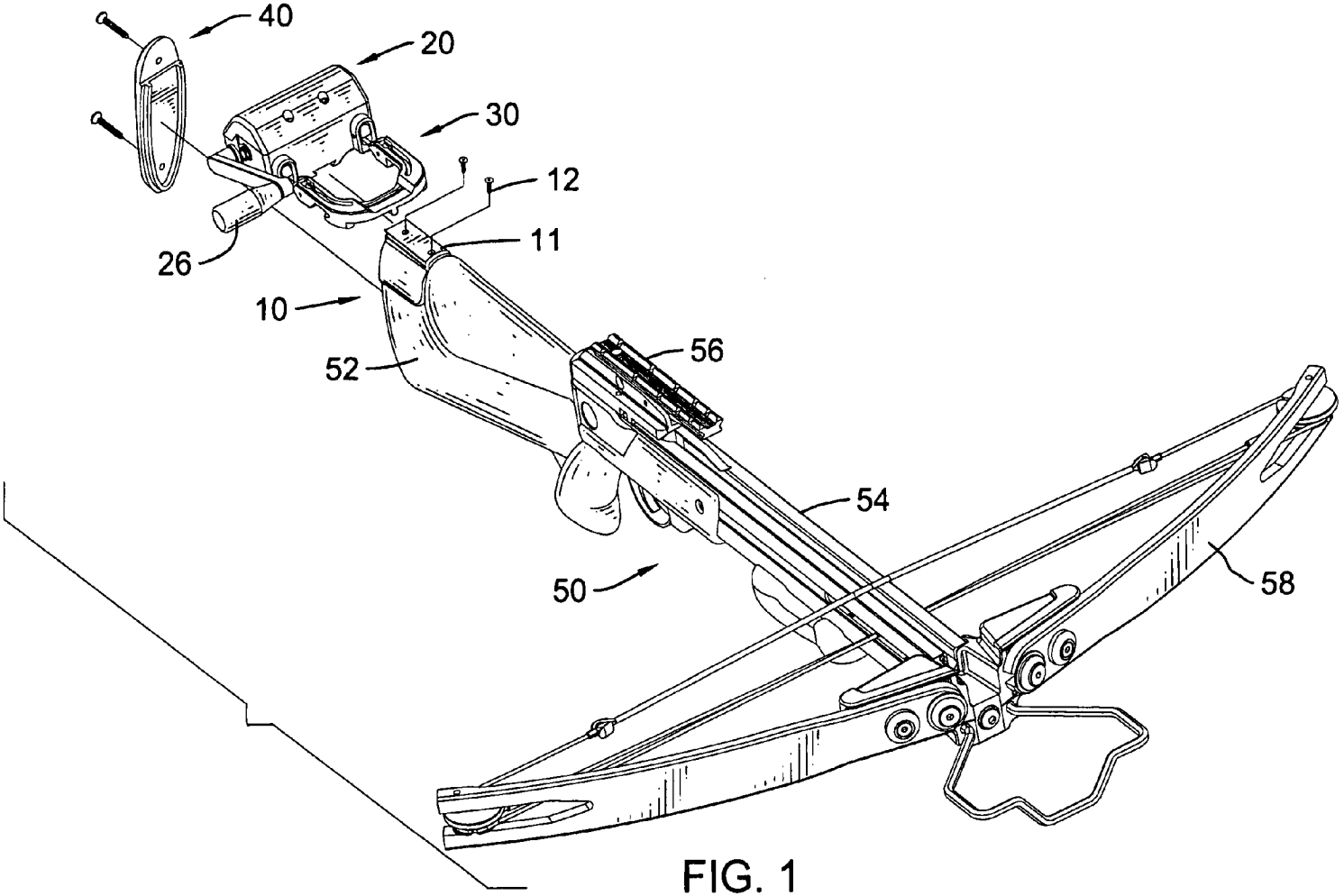
FIG. 1 is an exploded perspective view of a bowstring drawing device in accordance with the present invention, wherein the bowstring drawing device is arranged on a crossbow.
Figure 2:
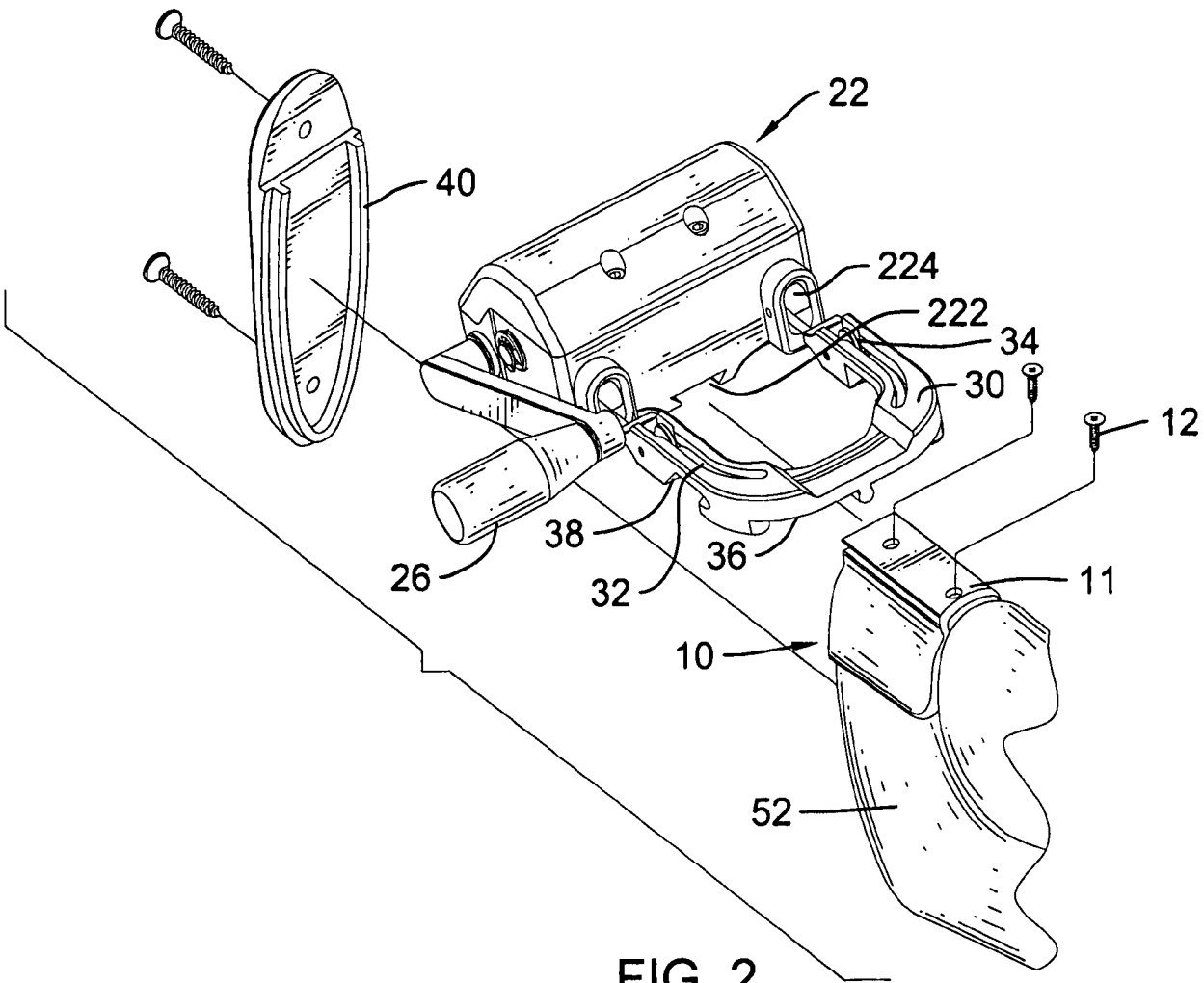
FIG. 2 is an enlarged exploded perspective view of the bowstring drawing device in FIG. 1.
Figure 3:
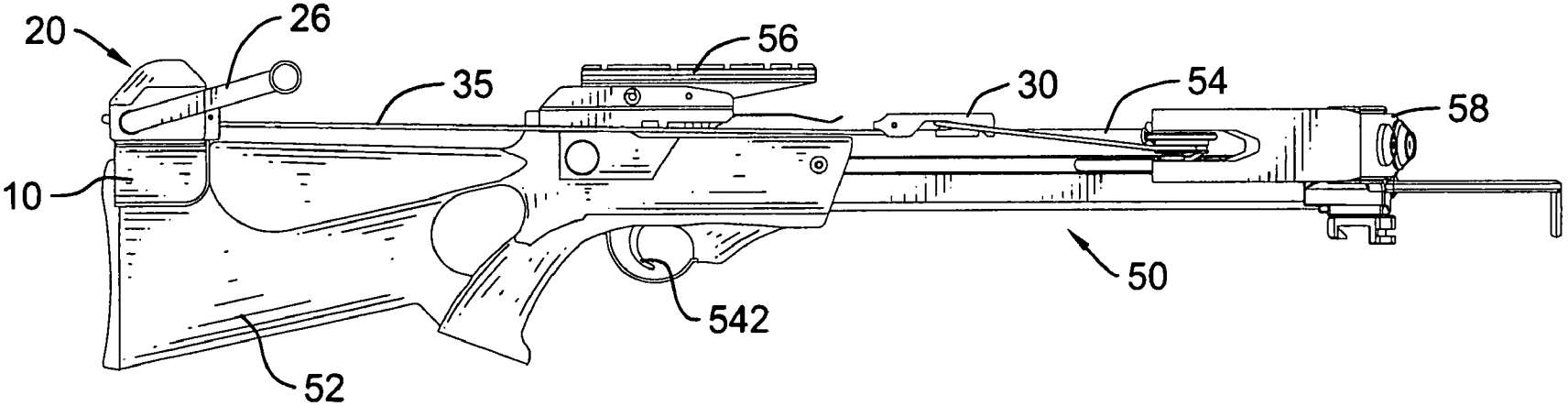
FIG. 3 is a cross-sectional side view of the bowstring drawing device that is mounted on the crossbow.

With reference to FIGS. 1 to 3, a preferred embodiment of the bowstring drawing device of the present invention comprises a mounting base (10), a reeling device (20), a hook (30), a string (35) and an optional backboard (40). The bowstring drawing device is attached on a crossbow substantially comprising a butt (52), a barrel (54), a bowstring holder (56) and a bow assembly (58). The barrel (54) is attached between the butt (52) and the bow assembly (58), and has a front end, a rear end, and a trigger (542). The bowstring holder (56) is mounted at the rear end of the barrel (54). The trigger (542) is movably attached under the barrel (54) to operationally actuate the bowstring holder (56).

The mounting base (10) is a U-shaped frame and has a top face, two sidewalls and a rail (11) formed on the top face. The mounting base (10) is mounted on the butt (52) by extending multiple screws (12) through a top face of the mounting base (10) to attach to the butt (52). The rail (11) is dovetail-shaped.

The reeling device (20) slidably engages the mounting base (10). As shown in FIGS. 2 and 4 to 6, the reeling device has a casing (22), a wheel assembly (24), a crank arm (26) and a clutch (28). The casing (22) is composed of a rectangular base and a curved cover and has a front face, a rear face, two side faces and a bottom face. The casing (22) further has a dovetail rail recess (222), two through holes (224), and a mounting hole. The dovetail rail recess (222) is defined in the bottom face to correspondingly engage with the rail (11) on the mounting base (10). The two through holes (224) are respectively defined in the front face near the two side faces to allow the string (35) to extend therethrough. The mounting hole is defined in one of the side faces.

The wheel assembly (24) has a polygonal shaft (241), two string wheels (242), a driving wheel (243), a driven wheel (244) and a unidirectional wheel (245). The polygonal shaft (241) is transversally and rotatably secured inside the casing (22). The two string wheels (242) are mounted on the polygonal shaft (241) respectively beside the two side faces of the casing (22) and the string (35) has two ends respectively reeling on the two string wheels (242). The driven wheel (244) is mounted on the polygonal shaft (241) beside one string wheel (242) and the unidirectional wheel (245) is also mounted on the polygonal shaft (241) beside the other string wheel (242). The driving wheel (243) and the clutch (28) are respectively and rotatably attached on two bases formed on the rear face inside the casing (22). The driving wheel (243) connects to the crank arm (26) and movably engages with the driven wheel (244). Therefore, the driving wheel (243) rotates with rotation of the crank arm (26) whereby the string wheels (242) rotate at the same time to reel or release the string (35).

Figure 6:
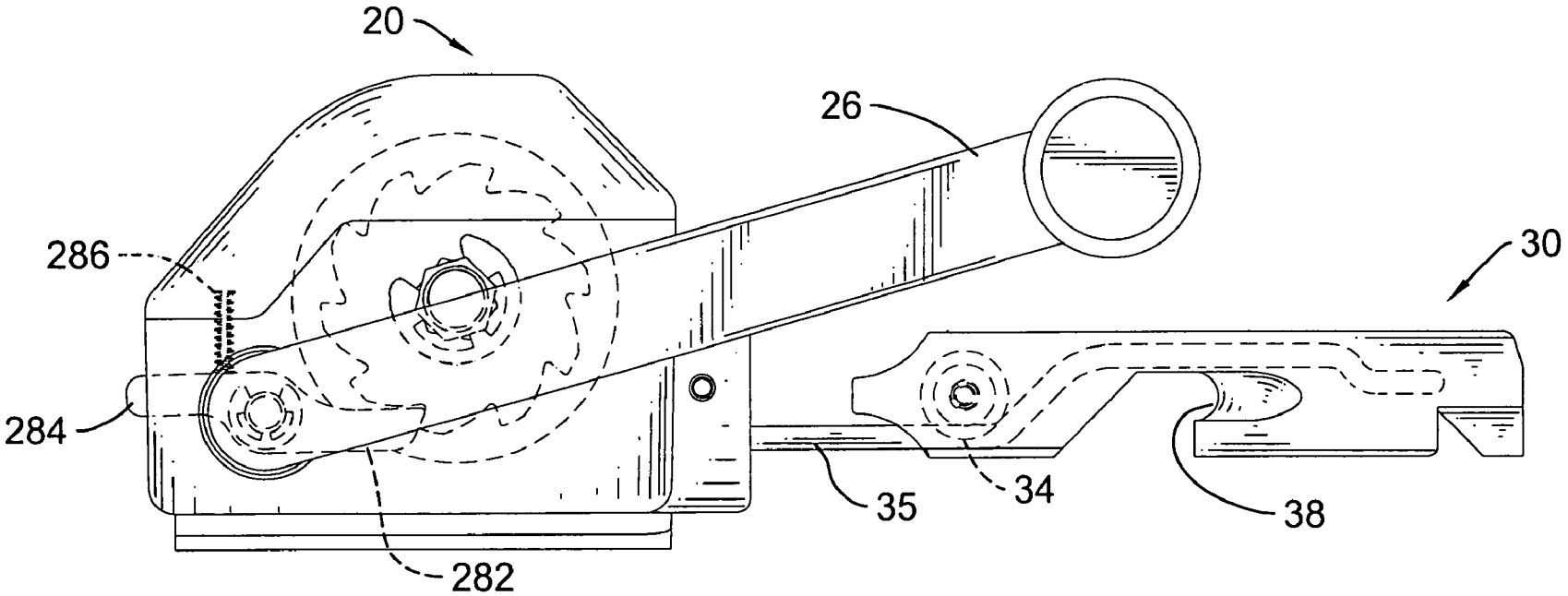
FIG. 6 a cross-sectional side view of the bowstring drawing device.

With particular reference to FIG. 6, the clutch (28) detachably engages the unidirectional wheel (245). The clutch (28) has an engaging end (282), a levering end (284) and a spring (286). The engaging end (282) matches with teeth on the unidirectional wheel (245) and the levering end (284) extends out of the rear face of the casing (22) to allow the clutch (28) to be operated. The spring (286) is clamped between the levering end (284) and the curved cover of the casing (22) to keep the engaging end (282) matching the unidirectional wheel (245). When the clutch (28) engages the unidirectional wheel (245), the string (35) can be drawn out freely since the unidirectional wheel (245) can rotate counter-clockwise to release the string (35). On the contrary, when the user wants to reel up the string (35), the clutch (38) is pushed upward to disengage the unidirectional wheel (245) to allow the unidirectional wheel (245) to rotate clockwise to retract the string (35).

Referring again to FIGS. 2, 4, 5 and 6, the hook (30) is preferably slidably mounted on the barrel (54) of the crossbow. The hook (30) is a U-shaped frame composed of two arms and a front edge, and has two distal ends, a bottom face, and a string channel (32) defined through the whole U-shaped frame. The hook (30) further has two rollers (34), a barrel recess (36) and two cutouts (38). The two rollers (34) are respectively attaching at the two distal ends. The barrel recess (36) is defined at the bottom face to slidably mount on a top face of the barrel (54). The two cutouts (38) are respectively defined in the bottom face under the two arms to hook the bowstring on the crossbow. The string channel (32) allows the string (35) to extend through the hook (30) to connect the hook (30) and the reeling device (20).

The backboard (40) is detachably mounted on the butt and the casing (22) of the reeling assembly (20) to provide a locking efficiency to the bowstring drawing device after the reeling assembly (20) is slidably engaged with the mounting base (10).

Figure 4:
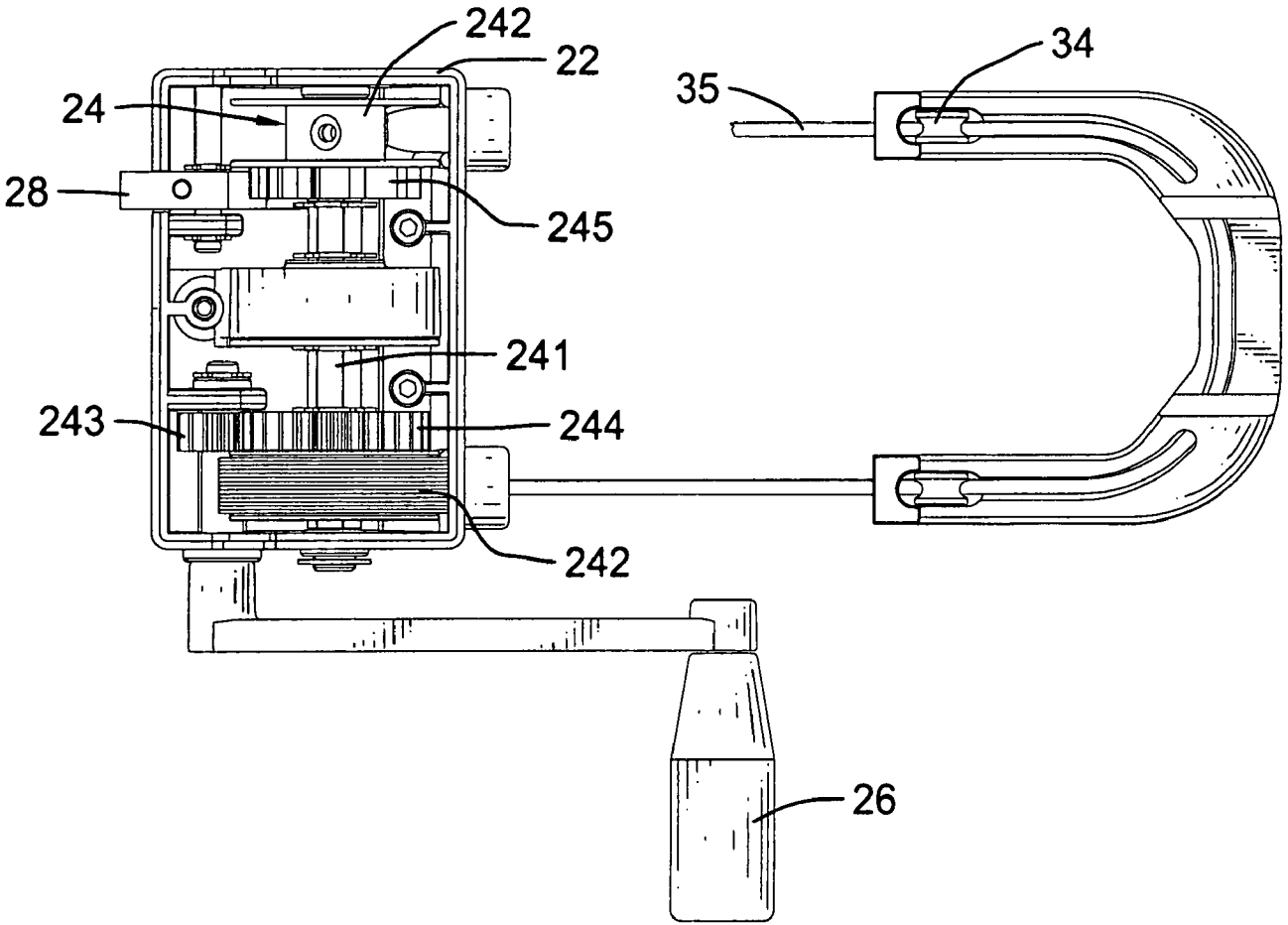
FIG. 4 is a partially cross-sectional top view of the bowstring drawing device.
Figure 5:
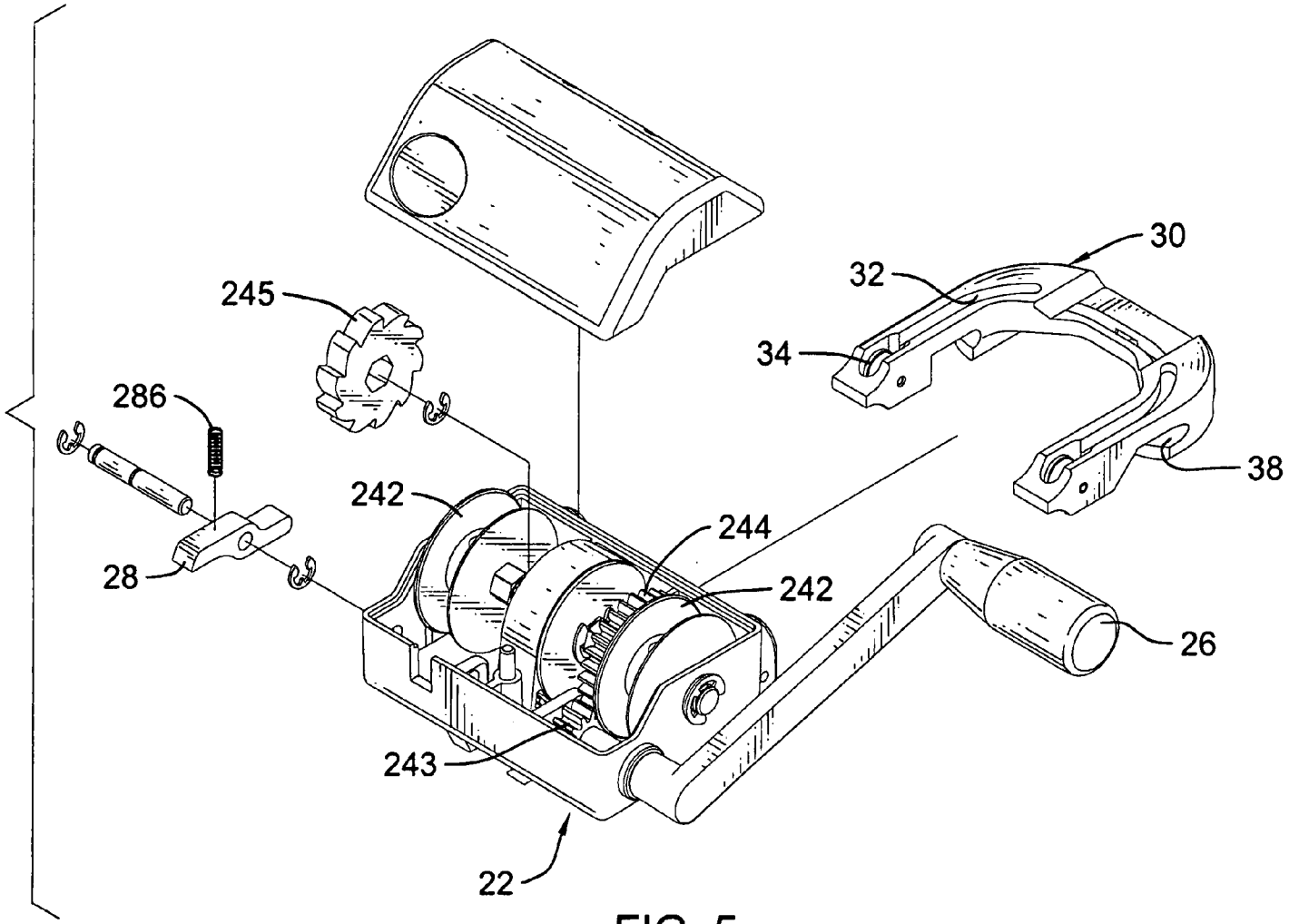
FIG. 5 is a partially exploded perspective view of a reeling device in the bowstring drawing device.
Figure 7:
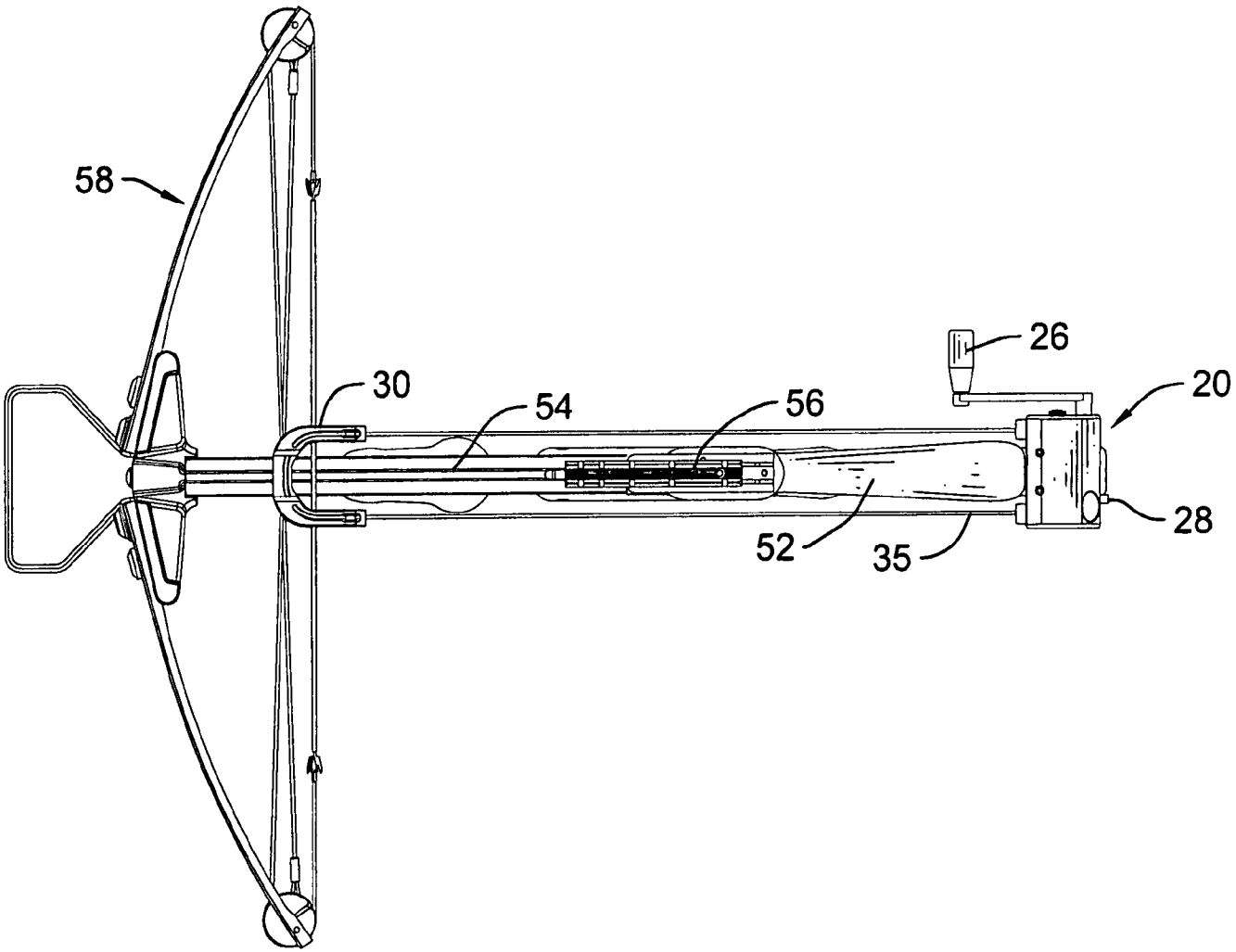
FIG. 7 is an operational top view of the bowstring drawing device mounted on the crossbow, wherein the hook just engages with a bowstring.
Figure 8:
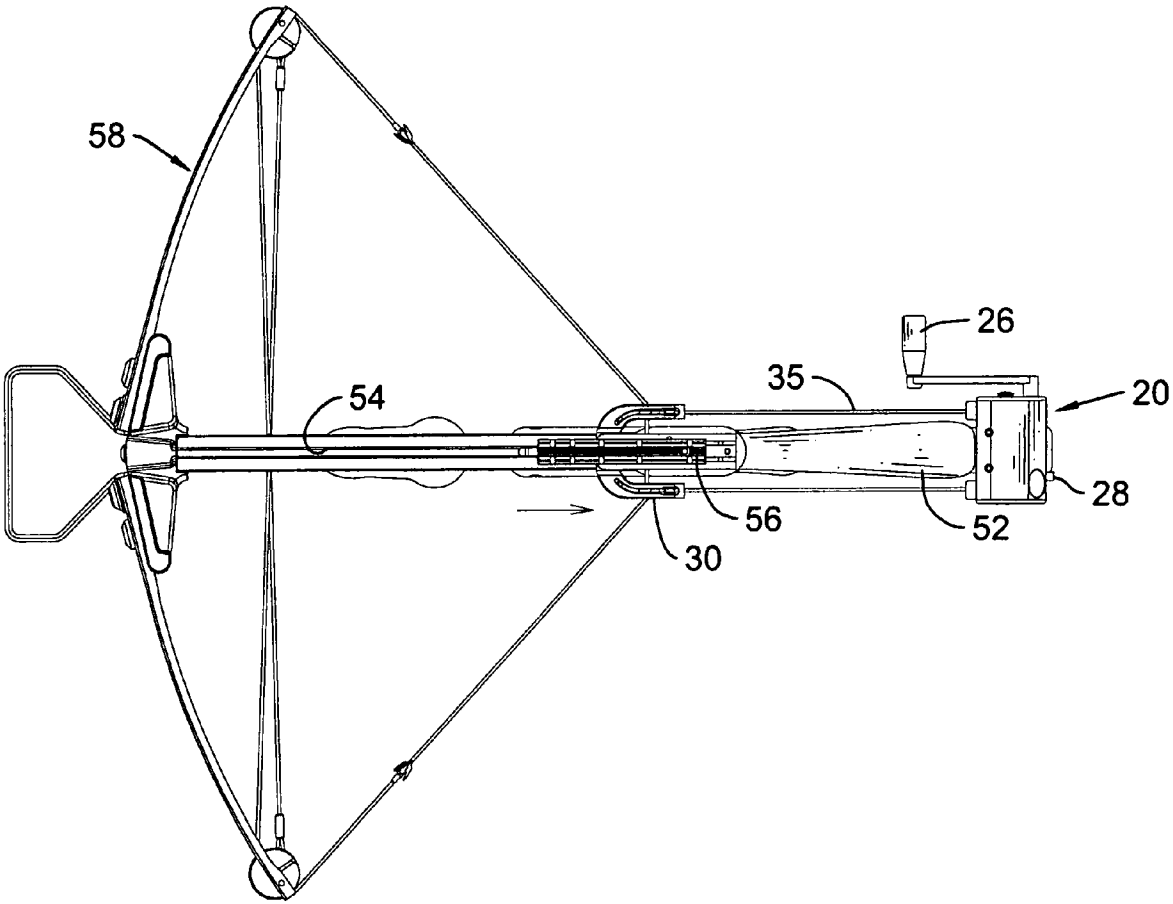
FIG. 8 an operational top view of the bowstring drawing device mounted on the crossbow, wherein the hook pulls the bowstring to a bowstring holder on the crossbow.

With reference to FIGS. 4, 7 and 8, when the bowstring drawing device operates, the hook (30) is directly drawn out to secure the bowstring inside the cutouts (38) on the bottom face. Then, the clutch (28) is pulled upward to release the unidirectional wheel (245) so that the user can turn the crank arm (26) to reel up the string (35) and draw the bowstring to reach the bowstring holder (56). When the hook (30) moves toward to the reeling assembly (20), the rollers (34) guide the string (35), evenly distributing pulling force from the reeling device (20) and moving the hook (30) stably. By using the crank arm (26) and the wheel assembly (24), the string (35) can be easily reeling back to the string wheels (242) to draw the bowstring to the bowstring holder by the hook (30).

Figure 9:
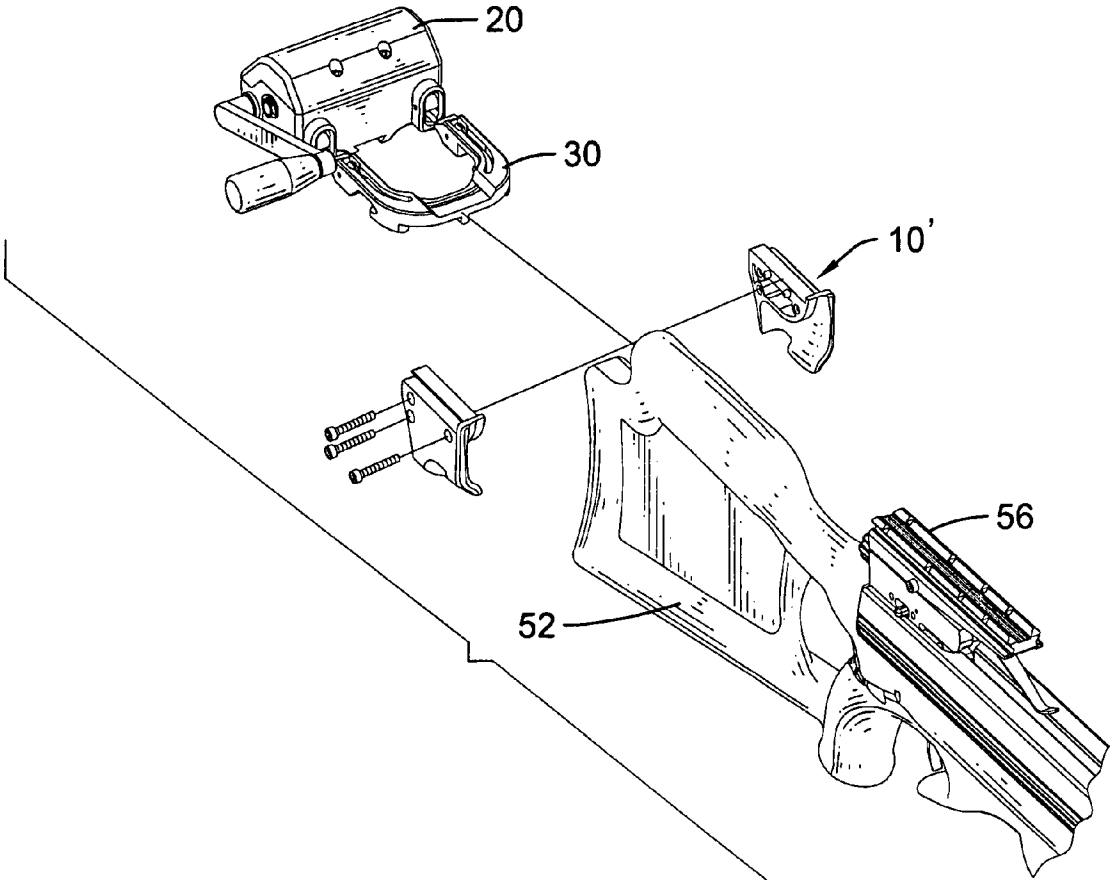
FIG. 9 is an exploded perspective view of another embodiment of the bowstring drawing device in accordance with the present invention.
Figure 10:
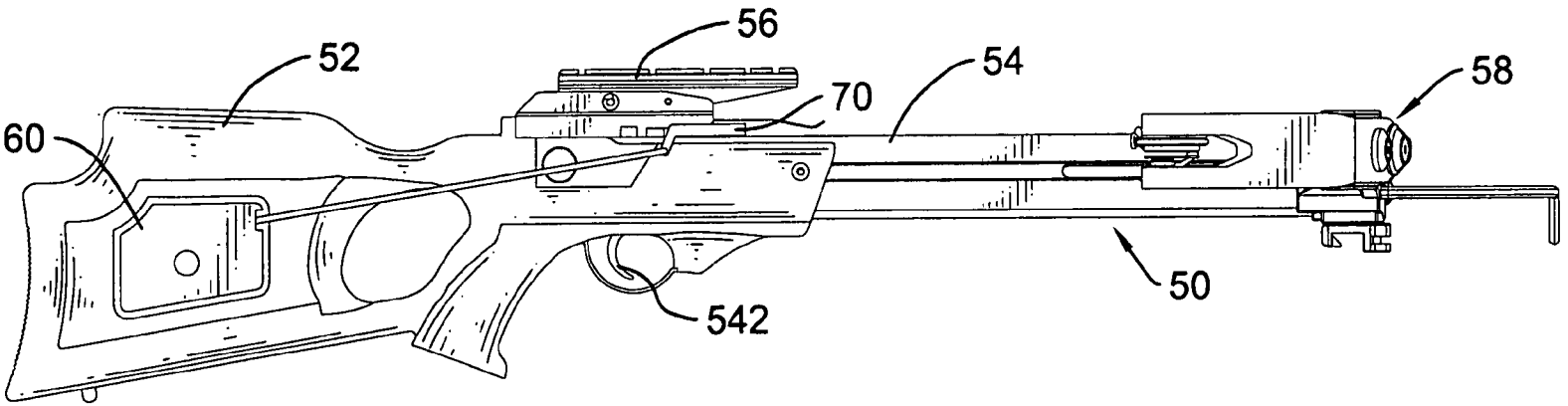
FIG. 10 PRIOR ART
FIG. 10 is a side view of a conventional bowstring drawing device with a crossbow in accordance with the prior art.

With reference to FIG. 9, another embodiment of the bowstring drawing device in accordance with the present invention has similar structure and shape with the former one except the mounting base (10') is composed of two shells symmetrically mounted on the butt of the crossbow by means of screws.

Because the reeling device (20) slidably engages the mounting base (10), the reeling device (20) and the hook (30) are detachable from the crossbow in a convenient way when the bowstring drawing device is not required. Moreover, the wheel assembly (24) and the crank arm (26) in the reeling device (20) make the drawing of the bowstring effort-saving and convenient.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A bowstring drawing device for a crossbow, the bowstring drawing device comprising:

a mounting base adapted to mount on a butt of the crossbow and having a rail;

a reeling device detachably attached to the mounting base and having a casing with a bottom face having a rail recess defined in the bottom face to slidably engage the rail on the mounting base;

a wheel assembly accommodated inside the casing to reel a string;

a crank arm connected to and driving the wheel assembly; and a clutch connected to and locking the wheel assembly; and a hook retractably connected to the reeling device by the string.

2. The bowstring drawing device as claimed in claim 1, wherein the mounting base (10) is a U-shaped frame and has a top face;

two sidewalls extending from the top face; and the rail (11) formed on the top face and being dovetail-shaped, wherein the rail recess (222) on the casing (22) is dovetail-shaped to correspondingly engage the rail (11) on the mounting base (10).

3. The bowstring drawing device as claimed in claim 2, wherein the casing (22) is composed of a rectangular base and a curved cover and has a front face, a rear face, two side faces and a bottom face;

two through holes (224) are respectively defined in the front face near the two side faces to allow the string to extend through the two through holes (224); and the wheel assembly (24) has:

a polygonal shaft rotatably secured inside the casing (22);

two string wheels (242) mounted on the polygonal shaft (241) respectively beside the two side faces of the casing (22);

a driven wheel (244) mounted on the polygonal shaft (241) beside one of the string wheels (242);

a unidirectional wheel (245) also mounted on the polygonal shaft (241) beside the other string wheel (242); and a driving wheel (243) rotatably driven by the crank arm (26) and engaging the driven wheel (244), wherein, the clutch (28) detachably engages the unidirectional wheel (245);and the string (35) has two ends respectively reeling on the two string wheels (242).

4. The bowstring drawing device as claimed in claim 3, wherein the clutch (28) has an engaging end (282) engaging the unidirectional wheel (245);

a levering end (284) extending out of the rear face of the casing (22); and a spring (286) clamped between the levering end (284) and the casing (22) to keep the engaging end (282) attaching the unidirectional wheel (245).

5. The bowstring drawing device as claimed in claim 4, wherein the hook (30) is U-shaped frame composed of two arms and a front edge and has two distal ends;

a bottom face;

a string channel (32) defined through the whole U-shaped frame to allow the string (35) to extend through the hook (30) through the string channel (32) so as to connect the hook (30) and the reeling device (20);

two rollers (34) respectively attaching at the two distal ends of the U-shaped frame;

a barrel recess (36) defined at the bottom face at the front edge; and two cutouts (38) respectively defined in the bottom face under the two arms.

6. The bowstring drawing device as claimed in claim 5, wherein the mounting base (10') is composed of two symmetrical shells.

7. The bowstring drawing device as claimed in claim 6, wherein the bowstring drawing device further has a backboard (40) detachably mounted on the casing (22) and adapted to mount on a butt of the crossbow.

8. The bowstring drawing device as claimed in claim 1, wherein the casing (22) is composed of a rectangular base and a curved cover and has a front face, a rear face, two side faces and a bottom face;

two through holes (224) are respectively defined in the front face near the two side faces to allow the string to extend through the two through holes (224); and the wheel assembly (24) has:

a polygonal shaft (241) rotatably secured inside the casing (22);

two string wheels (242) mounted on the polygonal shaft (241) respectively beside the two side faces of the casing (22);

a driven wheel (244) mounted on the polygonal shaft (241) beside one of the string wheels (242);

a unidirectional wheel (245) also mounted on the polygonal shaft (241) beside the other string wheel (242); and a driving wheel (243) rotatably driven by the crank arm (26) and engaging the driven wheel (244), wherein, the clutch (28) detachably engages the unidirectional wheel (245); and the string (35) has two ends respectively reeling on the two string wheels (242).

9. The bowstring drawing device as claimed in claim 1, wherein the hook (30) is U-shaped frame composed of two arms and a front edge and has two distal ends;

a bottom face;

a string channel (32) defined through the whole U-shaped frame to allow the string (35) to extend through the hook (30) through the string channel (32) so as to connect the hook (30) and the reeling device (20);

two rollers (34) respectively attaching at the two distal ends of the U-shaped frame;

a barrel recess (36) defined at the bottom face at the front edge; and two cutouts (38) respectively defined in the bottom face under the two arms.

* * * * *